United States Patent [19]

Gallaro

[11] Patent Number: 4,528,477

[45] Date of Patent: Jul. 9, 1985

[54] CRT WITH OPTICAL WINDOW

[75] Inventor: Anthony V. Gallaro, Auburn, N.Y.

[73] Assignee: North American Philips Consumer Electronics Corp., New York, N.Y.

[21] Appl. No.: 448,468

[22] Filed: Dec. 10, 1982

[51] Int. Cl.[3] ..... H01J 5/10; H01J 31/00

[52] U.S. Cl. ..... 313/479; 313/477 R

[58] Field of Search ..... 313/479, 477 R, 481, 313/474, 478, 480; 220/2.3 A

[56] References Cited

U.S. PATENT DOCUMENTS

| | | | |
|---|---|---|---|
| 2,749,449 | 6/1956 | Bradley et al. | 313/471 X |
| 4,025,815 | 5/1977 | Kurokawa et al. | 313/385 X |
| 4,210,844 | 7/1980 | Buescher et al. | 313/479 |
| 4,251,749 | 2/1981 | Compen et al. | 313/479 |

*Primary Examiner*—David K. Moore
*Assistant Examiner*—K. Wieder
*Attorney, Agent, or Firm*—Thomas A. Briody; Jack Oisher; John C. Fox

[57] ABSTRACT

Cathode ray tubes with optical windows in the sidewall or funnel portion thereof are provided with transparent conductive films of metal oxide on the inner surface of the funnel in the window area. Such films provide electrical continuity with the internal conductive coating of the tube, while permitting optical viewing. The films are produced by in-situ pyrolysis of films of metal resiantes in organic solvents.

5 Claims, 2 Drawing Figures

CRT WITH OPTICAL WINDOW

BACKGROUND OF THE INVENTION

This invention relates to a cathode ray tube containing an optical window in the funnel portion thereof, and more particularly, relates to such a tube having the inner surface of the window covered with a layer of transparent conductive material, and also relates to a method for producing such a tube.

In certain specialized applications, it is desirable to have one or more optical windows in the sidewall or funnel portion of a cathode ray tube (CRT), for example, to observe or measure the effects of radiation from the phosphors inside the CRT. The placement of such windows in the CRT presents some special problems for the tube designer. For example, a uniform electrical potential must be maintained between the last element (convergence cup) of the electron gun in the neck of the CRT and the mask-viewing assembly in the forward portion or face panel of the CRT. This is accomplished by applying such potential (via an anode button in the funnel sidewall) to an electrically conductive coating which completely covers the interior surface of the funnel from the mask area to the area of the convergence cup in the neck.

This conductive coating, known as Aquadag of Dag, is usually applied as a suspension of graphite and iron oxide particles in a coating vehicle, and when dry is optically opaque. Because of the high potentials of modern color CRTs, eg., 20 to 30 KV, the Dag coating desirably exhibits sufficient resistivity to dissipate stray currents caused by arcing, stray emissions and other sources. Conventional Dag coatings exhibit resistivities in the range of 200 to 1000 ohms. Electrical connection between the Dag and the mask and the Dag and the cup are usually accomplished by means of clips, snubbers or similar spring-type contactors. Connection of the mask to the screen is accomplished by means of a vapor deposited layer of aluminum completely covering the screen surface and screen panel sidewalls at least to a point providing electrical continuity with the mask through the mask's mounting brackets. Such an arrangement results in a space of uniform potential between the gun, mask and screen, enabling precise control of the paths of the electron beams emanating from the gun, and passing through the mask to impinge upon and excite the phosphor elements on the screen.

Since glass is an insulator, it can become charged, distorting the intended beam trajectories. It can thus be readily appreciated that any discontinuity in the internal conductive coating, such as a window, could cause perturbations in the potential field and thus deleteriously effect the deflection paths of the electron beams, with consequent degradation of the viewing screen image.

Electrical continuity could be provided by means of a transparent conductive film across the window area. Glass articles have been made conductive by heating the glass to its softening point, (eg., 500° to 675° C.) and spraying or fuming a solution of tin chloride with a small amount of antimony chloride onto the hot surface. Tin-antimony oxide is thus formed on the surface of the glass. However, unless the HCl (formed as a by-product of the hydrolysis of the metal chlorides) is carried away, such as by a stream of air, the surface of the glass may become clouded or white. Even if the HCl fumes were removed, there is always the danger of residual chloride which could poison the cathode and cause premature failure of the tube. Moreover, because the glass had to be heated to its softening point, glass pitting or distortion may occur. Also, application by spraying or fuming risks thermal shock to the heated glass and is difficult to confine to the desired area.

Other metal oxide films have been applied as transparent coatings on glass, by the pyrolysis of metallo-organic compounds. See, for example, U.S. Pat. No. 3,481,758, which describes such a coating for use as an optical filter on a lens. However, the electrical properties of such coatings vary widely and are of relatively little interest in such applications.

It is therefore, an object of this invention to provide a CRT containing one or more optical windows in the funnel portion thereof without interrupting the electrical continuity of the DAG coating, by providing a stable adherent transparent conductive coating over the window area, such coating exhibiting an electrical resistivity which is substantially compatible with that of the Dag coating, and making electrical contact therewith.

It is also an object of the invention to provide a method for applying such a coating which is both substantially reliable and compatible with existing CRT manufacturing processes.

SUMMARY OF THE INVENTION

According to the objects of the invention, a CRT with a window in the funnel portion thereof is provided with an adherent, transparent conductive metal oxide layer on the window's inner surface. A tin oxide-antimony oxide layer evidences a range of resistivities up to 1000 megohms.

The metal oxide layer is produced by in-situ heating of a layer of an organometallic formulation to cause pyrolysis thereof, resulting in driving off the organic constituents and leaving the residual metal oxide layer, coating or film.

The organometallic formulation is preferably a solution of one or more metal resinates in an organic solvent or coating vehicle. After pyrolysis, such formulation is converted to an adherent, transparent conductive coating by further heating.

DESCRIPTION OF THE PREFERRED EMBODIMENT

For a better understanding of the present invention, together with other and further objects, advantages and capabilities thereof, reference is made to the following disclosure and appended claims in conjunction with the accompanying drawings.

Figure 1:
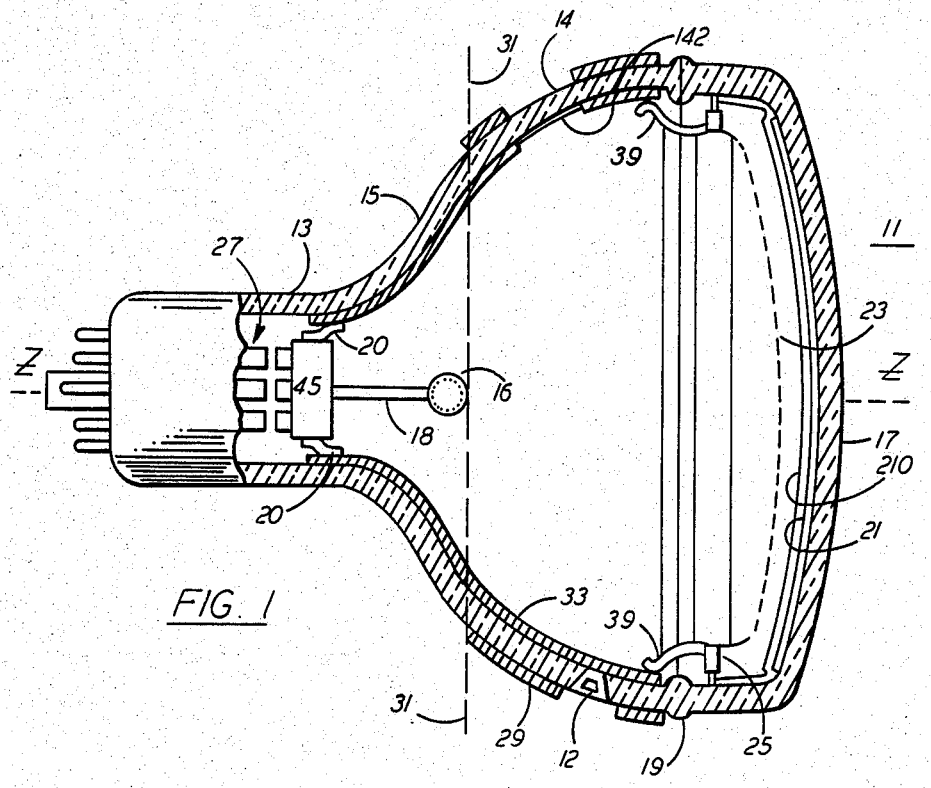
FIG. 1 is a cross-sectional view of a cathode ray tube wherein the invention is utilized.

With reference to FIG. 1, a plural beam color cathode ray tube construction 11 is illustrated as having an envelope comprised of an integration of neck 13, funnel 15 and face panel 17 portions; the panel and funnel portions being hermetically integrated during tube fabrication along the congruent sealing region 19. A patterned cathodoluminescent screen 21, of color-emitting phosphor areas, is disposed on the interior surface of the viewing panel 17 as an array of definitive stripes or dots, in keeping with the state of the art. A multi-apertured structure, in this instance, a shadow mask 23, having openings discretely shaped in keeping with the pattern of the screen, is oriented within the viewing panel by a plurality of locator means 25, in spatial relationship to the patterned screen.

An exemplary and partially detailed plural beam electron gun assembly 27 is positioned within the neck portion 13 of the envelope in a manner to project a plurality of electron beams to converge in the region of the shadow mask 23 and thence impinge upon the patterned screen 21.

It has been conventional practice to dispose electrically conductive coatings on both the interior and exterior surfaces of the funnel portion. These coatings in conjunction with the intervening glass of the funnel 15 form a capacitance filtering effect which is utilized in the operational circuitry of the associated television or image display device. The exterior coating 29 on the funnel member is of an electrically conductive material such as graphite formed from a suspension of graphite particles in a coating vehicle, and is disposed on a portion of the external surface extending from substantially the region adjacent the panel funnel seal 19 to a plane 31 substantially rearward of the mid-region of the funnel. An area around the electrical transversal or anode button 12, and as relates to this invention, a clear window area 14, are kept free of such coating. The interiorly applied coating 33 is normally formed of a similar coating material, but also containing particles of an oxide such as iron oxide. Such interior coating 33 has the electrical potential of the screen and the terminal electrode member of the electron gun assembly applied thereto by the funnel-disposed anode button 12. The coating 33 extends from substantially the region adjacent the panel-funnel seal 19 into the neck portion of the envelope to effect an electrical connection between the mask 23 via spring connectors 39 and the terminal electrode 45 of the electron gun assembly 27, via spring connectors 20. A high voltage is conventionally applied to the inner coating through the anode button 12.

A getter assembly 16 is mounted on an elongated metal spring member or wand 18. Wand 18 is attached to the top cup or convergence cup 45 of electron gun assembly 27.

Figure 2:
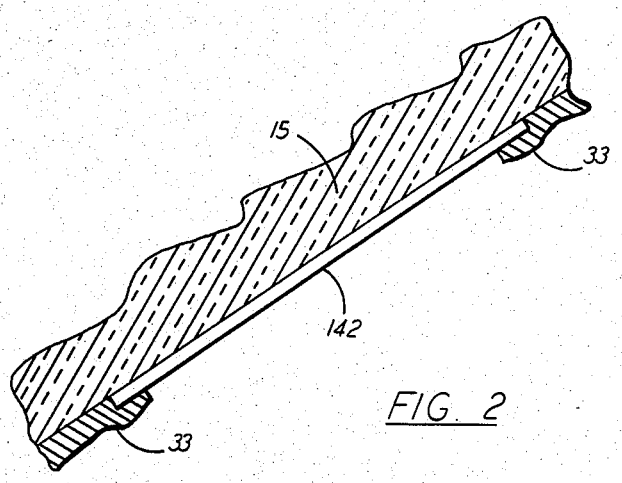
FIG. 2 is a detailed cross-sectional view of the window area of the cathode ray tube of FIG. 1.

FIG. 2 shows an enlarged broken section of funnel 15, with the transparent conductive layer 142 adhered to the inner surface thereof. In this embodiment, layer 142 has been made larger than the actual intended window size, and electrical connection to internal conductive layer 33 is assured by a slight overlapping of layer 142 by layer 33. Selective application techniques to achieve such structures are well known, eg., masking.

Layer 142 is applied as a liquid organometallic formulation which may readily be applied by brushing, spraying, rolling, etc. A variety of such organometallic formulations are known. They are generally based upon one or more metal resinates which may be mixed and their flow properties adjusted by the addition of common organic solvents, such as toluene, chloroform, benzyl acetate, and methylene chloride. Such metal resinates are commonly formed by the reaction of a metal salt with: an organic acid, such as an aliphatic carboxylic or aromatic acid; mercaptan; mixed complex of acid and amine; alcoholate; or chelate. When such organometallic formulations are applied to a glass surface and heated slowly in air, the film is pyrolyzed, that is, the organic components are volatilized, leaving behind a metal oxide film which may be as thin as 500 to 2000 Angstroms. Resinates of the desired metals are readily available commercially, and thus need not be prepared.

In order to achieve a film having a resistivity of no greater than 1000 megohms, some antimony oxide should be used in conjunction with tin oxide. The ratio of tin oxide to antimony oxide may vary widely, eg., from about 1:1 to 70:1, although it is preferred to maintain the ratio within the narrower limits of 1.1:1 to 2.6:1.

While pyrolysis of the above formulations may be substantially completed at temperatures as low as 200° to 350° C., heating at higher temperatures is needed to assure adequate adherence and conductivity. It is preferred to heat at a temperature of at least 450° C., for at least about one hour. Although not essential, it is preferred to heat in an oxidizing atmosphere in order to promote removal of carbon from the organic constituents by formation of carbon dioxide.

In order to substantially prevent static build-up, and to be compatible with the surrounding Dag coating, the metal oxide coating should have a resistivity no higher than 1000 megohms. Resistivity appears to be a minimum for a ratio of tin oxide to antimony oxide of about 1.6:1.

The heating atmosphere is preferably oxidizing in order to obtain substantially complete pyrolysis.

An exemplary liquid formulation is shown below:

24 milliliters: tin resinate (containing 3.1 weight percent Sn)

2 millimeters: antimony resinate (containing 15 weight percent Sb)

29 millimeters: Terpenol

The above formulation has a weight ratio of tin oxide to antimony oxide of 1.6:1. When painted or sprayed onto the interior surface of a cathode ray tube funnel, dried in air at 95° C. for one-half hour and baked in air at 450° C. for one (1) hour, the resultant mixed oxide coating exhibits a resistivity between 500 and 1000 megohms. Higher conductivity (lower resistivity) could be achieved by increasing the firing temperature and use of thicker coatings (with equal or higher temperatures). It is also noted that higher heating temperatures result in harder, more scratch-resistant coatings. However, temperatures near the softening point of the glass should be avoided for reasons stated above.

While there have been shown and described what are at present considered to be the preferred embodiments of the invention, it will be apparent to those skilled in the art that various changes and modifications may be made therein without departing from the scope of the invention as defined by the appended claims.

I claim:

1. In a cathode ray tube having an envelope formed of a sealed integration of neck, funnel and panel portions providing an enclosure for structural components including a multi-electrode electron gun assembly located in said neck portion in a manner to project at least one electron beam to traverse a multi-apertured member and impinge upon a cathodoluminescent screen disposed on the interior surface of said panel, a getter assembly, the funnel portion containing external and internal electrically conductive coatings interrupted in at least one area to define a clear window in the funnel wall; and an adherent electrically conductive, transparent metal oxide layer on the interior surface of the funnel wall completely covering the clear window, and making electrical contact with the internal conductive coating.

2. The metal oxide layer of claim 1 wherein the metal oxide comprises a composition of tin oxide and antimony oxide.

3. The metal oxide layer of claim 1 wherein the composition has tin oxide and antimony oxide in the weight ratio within the range of from about 1:1 to 70:1 of tin oxide to antimony oxide.

4. The layer of claim 2 in which the weight ratio of tin oxide to antimony oxide is from about 1.1:1 to 2.6:1.

5. The metal oxide layer of claim 1 evidencing an electrical resistivity of up to 1000 megohms.

* * * * *